US005887225A

United States Patent [19]

Bell

[11] Patent Number: 5,887,225

[45] Date of Patent: Mar. 23, 1999

[54] SOLID CARBON FIBER ELECTRICAL ROD DEVELOPER BIAS CONTACTING METHOD

[75] Inventor: Conrad J. Bell, Webster, N.Y.

[73] Assignee: Xerox Corporation, Stamford, Conn.

[21] Appl. No.: 2,967

[22] Filed: Jan. 5, 1998

[51] Int. Cl.[6] ..... G03G 15/00

[52] U.S. Cl. ..... 399/90

[58] Field of Search ..... 399/37, 88, 89, 399/90, 91, 168, 270, 285, 297, 354; 361/220, 221, 235; 439/92

[56] References Cited

U.S. PATENT DOCUMENTS

| | | | |
|---|---|---|---|
| 539,454 | 5/1895 | Thomson . | |
| 4,801,270 | 1/1989 | Scarlata | 439/92 |
| 5,010,441 | 4/1991 | Fox et al. | 361/221 |
| 5,177,529 | 1/1993 | Schroll et al. | 399/91 X |
| 5,250,994 | 10/1993 | Ito et al. | 399/90 |
| 5,270,106 | 12/1993 | Orlowski et al. | 361/220 X |
| 5,354,607 | 10/1994 | Swift et al. | 428/294 |
| 5,410,386 | 4/1995 | Swift et al. . | |
| 5,420,465 | 5/1995 | Wallace et al. | 307/116 |
| 5,436,696 | 7/1995 | Orlowski et al. . | |
| 5,537,189 | 7/1996 | Imes . | |
| 5,599,615 | 2/1997 | Swift et al. | 428/293.1 |
| 5,606,722 | 2/1997 | Hart et al. | 399/270 |
| 5,686,182 | 11/1997 | Maniar | 428/404 |
| 5,794,100 | 8/1998 | Bell et al. | 399/90 |

*Primary Examiner*—Sandra Brase
*Attorney, Agent, or Firm*—John S. Wagley

[57] ABSTRACT

A device for transferring electrical charge between a first element and a second element is provided the elements have an electrical potential therebetween. The device has a body including a multiplicity of electrically conductive carbon fibers. A substantial portion of the fibers extend in a substantially parallel direction, parallel to a first axis. The body includes a first contact area for contact with the first element. The body further includes a second contact area on the periphery thereof spaced from the first contact area, the second contact area for contact with the second element.

17 Claims, 7 Drawing Sheets

SOLID CARBON FIBER ELECTRICAL ROD DEVELOPER BIAS CONTACTING METHOD

This invention relates to electrostatographic printing machines, and, more particularly, to transferring electrical charge within an electrostatographic printing system.

Generally, the process of electrostatographic reproduction is executed by exposing a light image of an original document to a substantially uniform charged photoreceptive member. Exposing the charged photoreceptive member to a light image discharges the photoconductive surface thereof in areas corresponding to non-image areas in the original document while maintaining the charge on the image areas to create an electrostatic latent image of the original document on the photoconductive surface of the photoreceptive member. The latent image is subsequently developed into a visible image by depositing a charged developing material onto the photoconductive surface so that the developing material is attracted to the charged image areas thereon. The developing material is then transferred from the photoreceptive member to an output copy sheet on which the image may be permanently affixed in order to provide a reproduction of the original document. In a final step in the process, the photoreceptive member is cleaned to remove any residual developing material on the photoconductive surface thereof in preparation for successive imaging cycles.

The electrostatographic copying process described above is well known and is commonly used for light lens copying of an original document. Analogous processes also exist in other electrostatographic printing applications such as, for example, ionographic printing and reproduction, where charge is deposited on a charge retentive surface in response to electronically generated or stored images.

The electrostatographic copying process uses electrical charge extensively to perform the many operations of the process. For example, charging, development, transfer, detacking, and cleaning, regularly use the transfer of charge and in particular electrostatic charge to facilitate these respective processes.

Often, the electrical charge needs to be transferred either to or from a rotating element. Two particular methods of transferring an electrical charge either to or from a rotating element include the use of a stationary brush in rubbing contact with a rotating member. In the past, such flexible electroconductive members included a flexible electrically conductive sheet, metal strip, or a metallic brush, such as a brush of fine copper wires.

More recently, an additional material has been utilized for transferring an electrical charge to a rotating member to substitute for the use of a brush of fine copper wires. The material used as such a replacement material is a series of conductive fibers as disclosed in U.S. Pat. No. 5,420,465 to Wallace et al, the relative portions thereof incorporated herein by reference. This type of contact has advantages over prior art electrically stranded brushes, but has several remaining disadvantages including the complexity of such structures as well as the space constraints related to the complexity of these contacts.

An alternate to the use of a flexible contacting member against a rotating shaft is the use of steel rotating element bearings filled with electrically conductive grease. While the use of such bearings to transfer an electrical charge to a shaft provides for a simpler and less base consumptive configurations, the electrical contact through such conductive grease is at best unreliable.

Prior Art attempts at electrically commutating a rotating shaft have been in the form of a metallic stranded type brush or through the use of a conductive bearing including electrically conductive grease. The use of a metallic brush is plagued by excessive rapid wear and as such has high cost and it is not reliable. The use of a bearing with conductive grease is quite expensive and does not provide a particularly effective electrical passage and is thus not reliable.

Attempts have been made to improve the electrical commutation of shafts by the use of electrically conductive carbon impregnated fibers. Such a device is disclosed in U.S. patent application Ser. No. 08/823,405, by Bell, et al. and assigned to the same assignee as the subject invention. The fibers carbon commutating device of Ser. No. 08/823,405 was in the form of a plate including a internal opening which matingly fitted with the rotating shaft. The plate shape was brittle, expensive to make, and expensive to mount. Further, the plate type commutator included a fibulated fiber which contacted the shaft. The fibulated fibers tended to wear and sever from the commutator with particles going into areas adjacent to the commutator.

The fiber particles which separate from the commutator have a tendency to be attracted to areas within a printing or copy machine which may short an electrical system. This is particularly a problem for charging devices such as corotrons. Further, the contamination may be a problem for electrode type charged powder development apparatuses such as those disclosed in U.S. Pat. No. 4,868,600 to Hays, et al., the relative portions thereof incorporated herein by reference.

The use of the fibulated fiber causes for wear, possible intermittent contact, and the requirement of expensive tooling and engineering to obtain the shapes of the plate type commutators.

Further, the use of plate type commutators with fibulated fibers are difficult to incorporate into a field retrofit or improvement in an existing product.

The following disclosures appear to be relevant:

U.S. Pat. No. 5,686,182
Patentee: Maniar
Issued: Nov. 11, 1997

U.S. Pat. No. 5,599,615
Patentee: Swift, et al.
Issued: Feb. 4, 1997

U.S. Pat. No. 5,537,189
Patentee: Imes
Issued: Jul. 16, 1996

U.S. Pat. No. 5,436,696
Patentee: Orlowski, et al.
Issued: Jul. 25, 1995

U.S. Pat. No. 5,420,465
Patentee: Wallace et al.
Issued: May 30, 1995

U.S. Pat. No. 5,410,386
Patentee: Swift, et al.
Issued: Apr. 25, 1995

U.S. Pat. No. 5,354,607
Patentee: Swift, et al.
Issued: Oct. 11, 1994

U.S. Pat. No. 5,010,441
Patentee: Fox, et al
Issued: Apr. 23, 1991

U.S. Pat. No. 539,454
Patentee: Thomson
Issued: May 21, 1895

U.S. patent application Ser. No. 08/823,405
Patentee: Bell, et al.
Filed: Mar. 25, 1997

The relevant portions of the foregoing disclosures may be briefly summarized as follows:

U.S. Pat. No. 5,686,182 discloses a carrier comprised of a core with a coating thereover including at least one polymer resin and at least one fibrillated or non-fibrillated fibrous carbon additive, and wherein the outer surface of the coated carrier is fibrillated.

U.S. Pat. No. 5,599,615 discloses an electrical component for making electrical contact with another component including a composite member including a plurality of electrically conductive, non-metallic fibers in an electrically conductive metallic matrix wherein said composite member has an axial direction and a DC volume resistivity of less than about 100 micro ohm cm, said plurality of conductive fibers being oriented in said matrix in a direction substantially parallel to each other and to the axial direction of said member and said fibers being continuous from one end of said member to the other end to provide a plurality of electrical contact points at each end of said member, at least one end of said member having a brush-like structure of said plurality of fibers wherein said brush-like structure is at least substantially free of the metallic matrix, thereby providing a distributed filament contact wherein the terminating ends of the fibers in the brush-like structure define an electrically contacting surface.

U.S. Pat. No. 5,537,189 discloses a printing apparatus having a photosensitive member with an outer surface that has a conductive portion. A conductive brush including non-metallic fibers is in contact with the conductive portion of the photosensitive member to provide an electrically conductive path to the member.

U.S. Pat. No. 5,436,696 discloses a fibrillated pultruded electronic component for grounding a photoconductor. The component makes electrical contact with the photoconductor. A laser is used to produce the fibrillated structure.

U.S. Pat. No. 5,420,465 discloses switches and sensors which utilize pultrusion contacts. The switches include pultruded contact members. The pultruded contact members have an insulating body and a plurality of conductive fibers carried within the insulating body. The pultruded contact member is fibrillated to expose the conductive fibers for establishing electrical contact.

U.S. Pat. No. 5,410,586 discloses an electroconductive contact that is formed of a pultruded member that has a hollow construction. The pultruded member includes a plurality of continuous electroconductive strands embedded in resin material. One end of the pultruded member has a laser fibrillated strand for contact with a photoconductive belt.

U.S. Pat. No. 5,354,607 discloses a static eliminator device which includes a non-metallic pultruded composite member which has a plurality of conductive carbon fibers. The fibers are located in a polymer matrix of thermosetting resin. The carbon fibers are oriented in a longitudinal direction of the member and extend continuously throughout.

U.S. Pat. No. 5,010,441 discloses a device which electrically grounds a rotating shaft. A brush is mounted removably on the shaft. The brush has conductive fibers that extend outwardly over a portion thereof.

U.S. Pat. No. 539,454 discloses a commutator brush made of filamentary carbon coated with metal and mounted in a casing to strengthen it. The brush is composed of filamentary carbon connected together in layers or strips to the required thickness and size for the brush and united at one end and separate at the other end.

U.S. patent application Ser. No. 08/823,405 discloses a device for transferring electrical charge between a first element and a second element. The elements have relative rotational motion therebetween. The device has a body including a multiplicity of electrically conductive fibers. A substantial portion of the fibers extend in a substantially parallel direction, parallel to a first axis. The body includes a first contact area. The body defines an aperture therein. The body further includes a second contact area on the periphery of the aperture spaced from the first contact area. The first contact area is for contact with the first element and the second contact area is for contact with the second element.

As will be seen from an examination of the cited prior art, it is desirable to provide an electrostatographic copying machine with a simple, in expensive and compact, as well as reliable device, to transfer an electrical charge to or from a rotating member. The present invention is intended to alleviate at least some of the aforementioned problems with the prior art.

In accordance with one aspect of the invention, there is provided a device for transferring electrical charge between a first element and a second element. The elements have, an electrical potential therebetween. The device has a body including a multiplicity of electrically conductive carbon fibers. A substantial portion of the fibers extend in a substantially parallel direction, parallel to a first axis. The body includes a first contact area for contact with the first element. The body further includes a second contact area on the periphery thereof spaced from the first contact area, the second contact area for contact with the second element.

In accordance with another aspect of the present invention, there is provided a developer unit for use in an electrophotographic printing machine. The machine is of the type having an electrostatic latent image recorded on a photoconductive member in which an electrical charge is transferred between the developer unit and a second element having an electrical potential therebetween. The developer unit includes a housing defining a chamber for storing a supply of toner particles therein. The first element is operably associated with the housing. The developer unit also includes a developer roll operably associated with the housing for transporting the toner particles on a surface thereof from the chamber of the housing to the member. The developer unit further includes a device for transferring electrical charge between the first element and the second element. The device includes a body having a multiplicity of electrically conductive carbon fibers. A substantial portion of the fibers extend in a substantially parallel direction, parallel to a first axis. The body includes a first contact area for contact with the first element. The body further includes a second contact area on the periphery thereof spaced from the first contact area. The second contact area provides contact with the second element.

In accordance with a further aspect of the present invention, there is provided a printing apparatus including a first element and a second element having an electrical potential therebetween. The printing apparatus includes a device for transferring electrical charge between the first element and the second element. The device has a body including a multiplicity of electrically conductive fibers. A substantial portion of the fibers extend in a substantially parallel direction, parallel to a first axis. The body includes a first contact area for contact with the first element. The body further includes a second contact area on the periphery thereof spaced from the first contact area, the second contact area for contact with the second element.

For a general understanding of the present invention, as well as other aspects thereof, reference is made to the following description and drawings, in which like reference numerals are used to refer to like elements, and wherein.

While the present invention will be described with a reference to preferred embodiments thereof, it will be understood that the invention is not to be limited to these preferred embodiments. On the contrary, it is intended that the present invention cover all alternatives, modifications, and equivalents as may be included within the spirit and scope of the invention as defined by the appended claims. Other aspects and features of the present invention will become apparent as the description proceeds.

Figure 7:
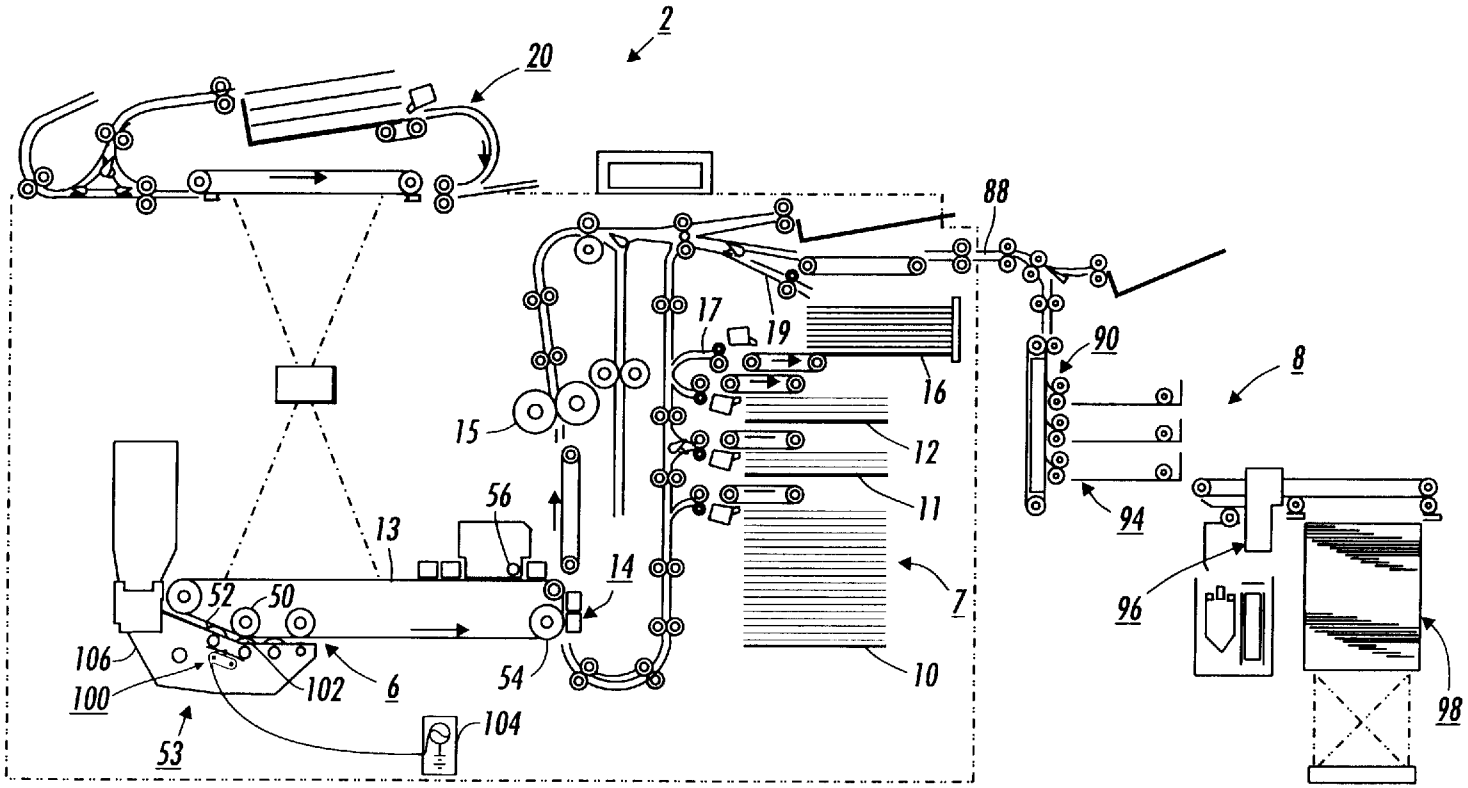
FIG. 7 is a schematic elevational view of a printing machine incorporating the electrical charge transferring device of FIG. 1.

Inasmuch as the art of electrostatographic processing is well known, the various processing stations employed in a typical electrostatographic copying or printing machine of the present invention will initially be described briefly with reference to FIG. 7. It will become apparent from the following discussion that the paper feeding system of the present invention is equally well suited for use in a wide variety of other electrophotographic or electronic printing systems, as for example, ink jet, ionographic, laser based exposure systems, etc.

In FIG. 7, there is shown, in schematic form, an exemplary electrophotographic copying system 2 for processing, printing and finishing print jobs in accordance with the teachings of the present invention. For purposes of explanation, the copying system 2 is divided into a xerographic processing or printing section 6, a sheet feeding section 7, and a finishing section 8. The exemplary electrophotographic copying system 2 of FIG. 6 incorporates a recirculating document handler (RDH) 20 of a generally known type, which may be found, for example, in the well known Xerox Corporation model "1075", "5090" or "5100" duplicators. Such electrostatographic printing systems are illustrated and described in detail in various patents cited above and otherwise, including U.S. Pat. No. 4,961,092, the principal operation of which may also be disclosed in various other xerographic or other printing machines.

Since the copy or print operation and apparatus of the present invention is well known and taught in numerous patents and other published art, the system will not be described in detail herein. Briefly, blank or preprinted copy sheets are conventionally provided by sheet feeder section 7, whereby sheets are delivered from a high capacity feeder tray 10 or from auxiliary paper trays 11 or 12 for receiving a copier document image from photoreceptor 13 at transfer station 14. In addition, copy sheets can be stored and delivered to the xerographic processing section 6 via auxiliary paper trays 11 or 12 which may be provided in an independent or stand alone device coupled to the electrophotographic printing system 2. After a developed image is transferred to a copy sheet, an output copy sheet is delivered to a fuser 15, and further transported to finishing section 8 (if they are to be simplex copies), or, temporarily delivered to and stacked in a duplex buffer tray 16 if they are to be duplexed, for subsequent return (inverted) via path 17 for receiving a second side developed image in the same manner as the first side. This duplex tray 16 has a finite predetermined sheet capacity, depending on the particular copier design. The completed duplex copy is preferably transported to finishing section 8 via output path 88. An optionally operated copy path sheet inverter 19 is also provided.

Output path 88 is directly connected in a conventional manner to a bin sorter 90 as is generally known and as is disclosed in commonly assigned U.S. Pat. No. 3,467,371 incorporated in its entirety by reference herein. Bin sorter 90 includes a vertical bin array 94 which is conventionally gated (not shown) to deflect a selected sheet into a selected bin as the sheet is transported past the bin entrance. An optional gated overflow top stacking or purge tray may also be provided for each bin set. The vertical bin array 94 may also be bypassed by actuation of a gate for directing sheets serially onward to a subsequent finishing station. The resulting sets of prints are then discharged to finisher 96 which may include a stitcher mechanism for stapling print sets together and/or a thermal binder system for adhesively binding the print sets into books. A stacker 98 is also provided for receiving and delivering final print sets to an operator or to an external third party device.

Referring again to FIG. 7, the carbon fiber electrical contact for rotating the elements according to the present invention may be utilized in a varying number of applications within the printing machine 2. These applications include any element within the machine which requires a charge or an electrical bias to optimally perform. For example, an electrical charge can be provided to photoconductive belt 13 through backup roll 50. The carbon fiber electrical contact of the subject invention thus may be utilized on the backup roll 50.

Stripping roll 54 may likewise use the carbon fiber electrical contact to transfer electrical charge across the roll 54. Further, cleaning brush 56 may utilize the carbon fiber electrical contact to transfer electrical charge through the cleaning brush 56.

Also, electrical bias can be transferred through developer roll 52 within developer unit 53. Likewise, the carbon fiber electrical contact of the present invention may be utilized to transfer electrical charge through the developer roll 52.

It should be appreciated that the locations of the backup roll 50, developer roll 52, detack roll 54 and cleaning brush 56 are merely examples of the possible applications for the carbon fiber electrical contact of the present invention. It should be appreciated that the electrical contact may be used anywhere where an electrical charge needs to be transferred between a rotating element and an adjacent fixed element.

The electrical contact of the present invention provides for greatly improved reliability, low cost and easy manufacture and are highly suitable to operate in low energy circuits. Typically these devices are low energy devices, using voltages within the range of millivolts to kilovolts. They may also use currents within the range of microamps to milliamps as opposed to high power applications that normally employ tens to hundreds of amperes at very high voltages, for example. Typically these devices are used where concern for the power dissipated at the interfacial surfaces is negligible, for example, in the cases where high voltages (in kilovolts) are coupled with microampere currents, or, at low voltage, i.e. logic levels and currents in the tens of milliampere range.

Although the present invention may be used in certain applications in the single amp to tens of amps region it is noted that best results are obtained in high or low voltage, low energy circuitry where power losses can be tolerated. It is also noted that these devices may be used in certain applications in the high voltage region in excess of 10,000 volts, for example, where excessive heat is not generated. These devices can be characterized as generally electronic in nature within the generic field of electrical devices meaning that their principle applications are in certain low power applications where their inherent power losses may be tolerated.

Preferably, the electrical contact is made from a pultruded composite member which provides a densely distributed filament contact with another component. By the term densely distributed filament contact it is intended to define an extremely high level of contact redundancy insuring electrical contact with another contact surface in that the contacting components has in excess of 1000 individual conductive fibers per square millimeter.

In accordance with a preferred embodiment of the invention, the use of a pultrusion of the type having a plurality of conductive fibers carried within a host matrix (sometimes referred to as a distributed fiber pultrusion) serving as electrical contacts is advanced. Rigid and sliding contacts employing this feature can be fabricated at very low cost. Due to the inertness and reliability of the distributed fiber contact, many new device configurations which otherwise would have used metal contacts in open air and therefore would have been judged to be unreliable, can be now enabled. With the realization that a pultruded carbon material can be used as both a contact member and a structural component, it becomes apparent that these features can be combined into a multiple function device thereby enabling even higher value-added devices.

Such contacts can serve a variety of applications within a xerographic engine and its peripherals, all enabled by pultruded carbon fiber bars, tubes, rods or sheets which are ordinarily rigid and can be easily contacted for electrical connections as below described in detail.

Thus, in accordance with the present invention, an improved electrical contact device is provided that is of improved reliability, is of low cost and is easily manufacturable. These advantages are enabled through the use of a manufacturing process known generally as a pultrusion process. One pultrusion composition that can be employed in practicing this invention is of the type that comprises continuous strands of resistive carbon fiber filler with a host polymer. Such carbon fiber pultrusions are a subcategory of high performance conductive composite plastics, and comprise one or more types of continuous, conductive reinforcing filaments in a binder polymer. They provide a convenient way to handle, process and use fine diameter, carbon fibers without the problems typically encountered with free conductive fibers.

The pultrusion process generally consists of pulling continuous lengths of fibers first through a resin bath or impregnator, then into a preforming fixture where the resulting section is at least partially shaped and excess resin and/or air are removed. The section is then pulled into heated dies where it is continuously cured. For a detailed discussion of pultrusion technology, reference is directed to "Handbook of Pultrusion Technology" by Raymond W. Meyer, first published in 1985 by Chapman and Hall, N.Y.

More specifically, in the practice of the invention, conductive carbon fibers are submersed in a polymer bath and drawn through a die opening of suitable shape at high temperature to produce a solid piece having dimensions and shapes of that of the die. The solid piece can then be cut, shaped, or machined. As a result, a solid piece can be achieved that has thousands of conductive fiber elements contained within the polymer matrix, where the ends of the fiber elements can be exposed to provide electrical contacts. The very large redundancy and availability of electrical contacts enables a substantial improvement in the reliability of such devices.

Since the plurality of small diameter conductive fibers are pulled through the polymer bath and heated die as a continuous length, the shaped member can be formed with the fiber being continuous from one end of the member to the other. Accordingly, the pultruded composite may be formed in a continuous length during the pultrusion process, then cut to any suitable dimension, with a very large number of electrical contacts provided at each end.

Any suitable fiber having a suitable resistivity may be used in the practice of the invention. Typically, the conductive fibers are non-metallic and have a DC volume resistivity of from about $1\times10^{-5}$ to about $1\times10^{+11}$ ohm-cm and preferably from about $1\times10^{-5}$ to about 10 ohm-cm to minimize losses and suppress RFI. The upper range of resistivities of up to $1\times10^{+11}$ ohm-cm could be used, for example, in those special applications involving extremely high fiber densities where the individual fibers act as individual resistors in parallel and to prevent arcing thereby lowering the overall resistance of the pultruded member while enabling current conduction. Higher resistivity materials may be used if the input impedance of the associated electronic circuit is sufficiently high. The vast majority of applications however, will require fibers having resistivities with in the above-stated preferred range to enable efficient current conduction.

The term "non-metallic" is used to distinguish from conventional metal-wire fibers which exhibit metallic conductivity having resistivity of the order of $1\times10^{-6}$ ohm-cm and to define a class of fibers which are non-metallic but can be treated in ways to approach or provide metal like properties However, carbon fibers are particularly well suited as the preferred fiber because they are chemically and environmentally inert, possess high strength and stiffness, can be tailored to virtually any desired resistivity, and exhibit a negative coefficient of thermal resistivity. Further, they are easily compounded with a wide variety of thermoplastic and thermosetting resins into high strength pultrusions.

In addition, the individual conductive fibers can be made circular in cross section with a diameter generally in the order of from about 4 micrometers to about 50 and preferably from about 5 micrometers to 10 micrometers. This provides a very high degree of fiber redundancy in a small cross sectional area. Thus, as contact materials, the large number of fibers provide a multiple redundancy of contact points, for example, in the range between about $0.05\times10^{+5}$ and $5\times10^{+5}$ contacts/cm$^2$. This is believed to enable ultra-high contact reliability. It should be appreciated that blends of fibers having different sizes are possible.

The fibers are typically flexible and compatible with the polymer systems within which they are carried. Typical fibers may include carbon, carbon/graphite, metallized or metal coated carbon fibers, metal coated glass, and metal coated polymeric fibers. A particularly preferred class of fibers that may be used are those fibers that are obtained from controlled heat treatment process to yield complete or partial carbonization of polyacrylonitrile (PAN) precursor fibers. It has been found for such fibers that by carefully controlling the temperature of carbonization within certain limits that precise electrical resistivities for the carbonized carbon fibers may be obtained.

The carbon fibers from polyacrylonitrile (PAN) precursor fibers are commercially produced by Graphil, Inc., Amoco Performance Products, Inc., and others in yarn bundles of 1,000 to 160,000 filaments commercially referred to as "Tows." Metal plated carbon fibers are available from Novamet Specialty.

The Tows are typically carbonized in a two-stage process. The first stage involves stabilizing the PAN fibers at temperatures of the order of 300° C. in an oxygen atmosphere to produce preox-stabilized PAN fibers. The second stage involves carbonization of the fibers at elevated temperatures in an inert atmosphere, such as an atmosphere containing nitrogen. The DC electrical resistivity of the resulting fibers is controlled by the selection of the temperature and time of carbonization.

For example, carbon fibers having an electrical resistivity of from about $10^2$ to about $10^6$ ohms-cm are obtained if the carbonization temperature is controlled in the range of from about 500° C. to 750° C., while carbon fibers having D.C. resistivities of $10^{-3}$ to about $10^{-5}$ ohm-cm result from treatment temperatures of 1800° to 2000° C. For further reference to the processes that may be employed in making these carbonized fibers, attention is directed to U.S. Pat. No. 4,761,709 to Ewing et al and the literature sources cited therein at column 8.

Typically, these carbonized fibers have a tensile modulus of from about 30 million to 60 million psi or 205 to 411 GPa which is higher than many metals thereby enabling a very strong pultruded composite member. The highest temperature conversion of the polyacrylonitrile fibers results in a fiber which is about 99.99% elemental carbon which is inert and will resist oxidation.

One of the advantages of using conductive carbon fibers is that they have a negative coefficient of thermal conductivity so that as the individual fibers become hotter with the passage of, for example, a spurious high current surge, they become more conductive. This provides an advantage over metal contacts as the coefficient of thermal conductivity of metals operate in just the opposite manner and therefore metal contacts tend to bum out or self-destruct.

The carbon fibers have the further advantage in that their surfaces are inherently rough and porous thereby providing good adhesion to the polymer matrix. In addition, the inertness of the carbon material yields a contact surface relatively immune to the typical contaminants of that affected metal. The carbon fibers are enclosed in any suitable polymer matrix.

The polymer matrix should be of a resin binder material that will volatilize rapidly and cleanly upon direct exposure to the laser beam during laser processing below described. Polymers such as low molecular weight polyethylene, polypropylene, polystyrene, polyvinylchloride, and polyurethane may be particularly advantageously employed. Polyesters, epoxies, vinyl esters, polyetheretherketones, polyetherimides, polyethersulphones and nylon are in general, suitable materials with the cross-linkable polyesters and vinylesters being preferred due to their short cure time, relative chemical inertness, and suitability for laser processing.

Referring again to FIG. 7 and according to the present invention, a device 100 is shown for transferring electrical charge. The charge transfer device 100 is shown mounted to developer unit 53. The charge transferring device 100 is in electrical contact with developer roll 52. The charge transfer device 100 may also, as shown in FIG. 7, be an electrical contact with second developer roll 102. The charge transfer device 100 transfers an electrical charge from voltage source 104 to the developer rolls 52 and 102. The charge transfer device 100 may be secured in any fashion. For example, the charge transfer device 100 may be mounted to developer housing 106.

Figure 2:
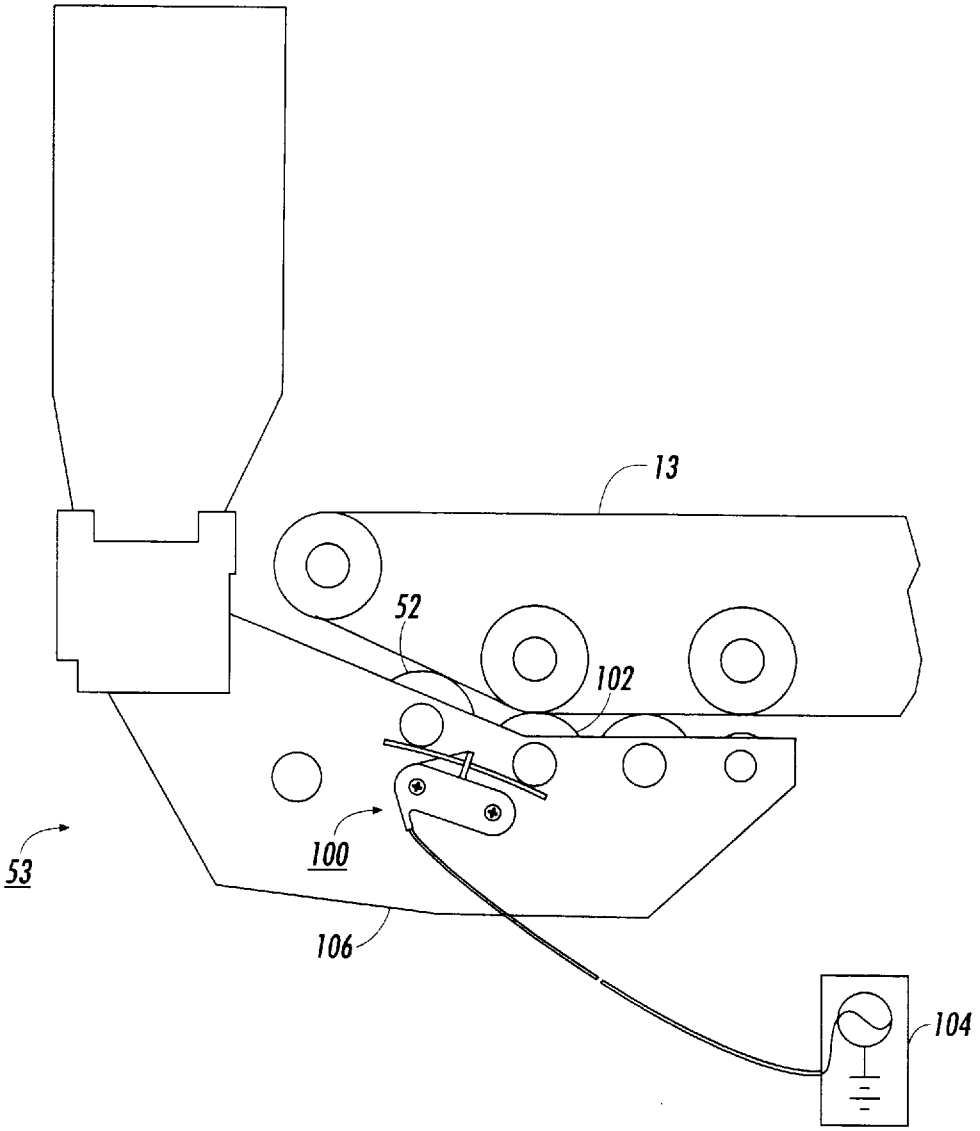
FIG. 2 is a plan view of the developer unit including the device of FIG. 1.

Referring now to FIG. 2, the developer unit 53 is shown in greater detail. The charge transfer device 100 may be positioned anywhere with respect to the developer unit 53 such that the charge transfer device serves to transfer charge from the voltage source 104 to the develop rolls 52 and 102. For example, as shown in FIG. 2, the charge transfer device 100 is mounted to development housing 106.

It should be appreciated that the charge transfer device 100 may be used for transferring electrical charge between a first element and a second element. The first element and second element may have an electrical potential between each other. Any location within the copy or printing machine in which electrical potential needs to be applied to a particular area or in which an electrical charge needs to be dissipated, i.e. a particular area needs to be grounded, the device 100 is well suited.

Figure 1:
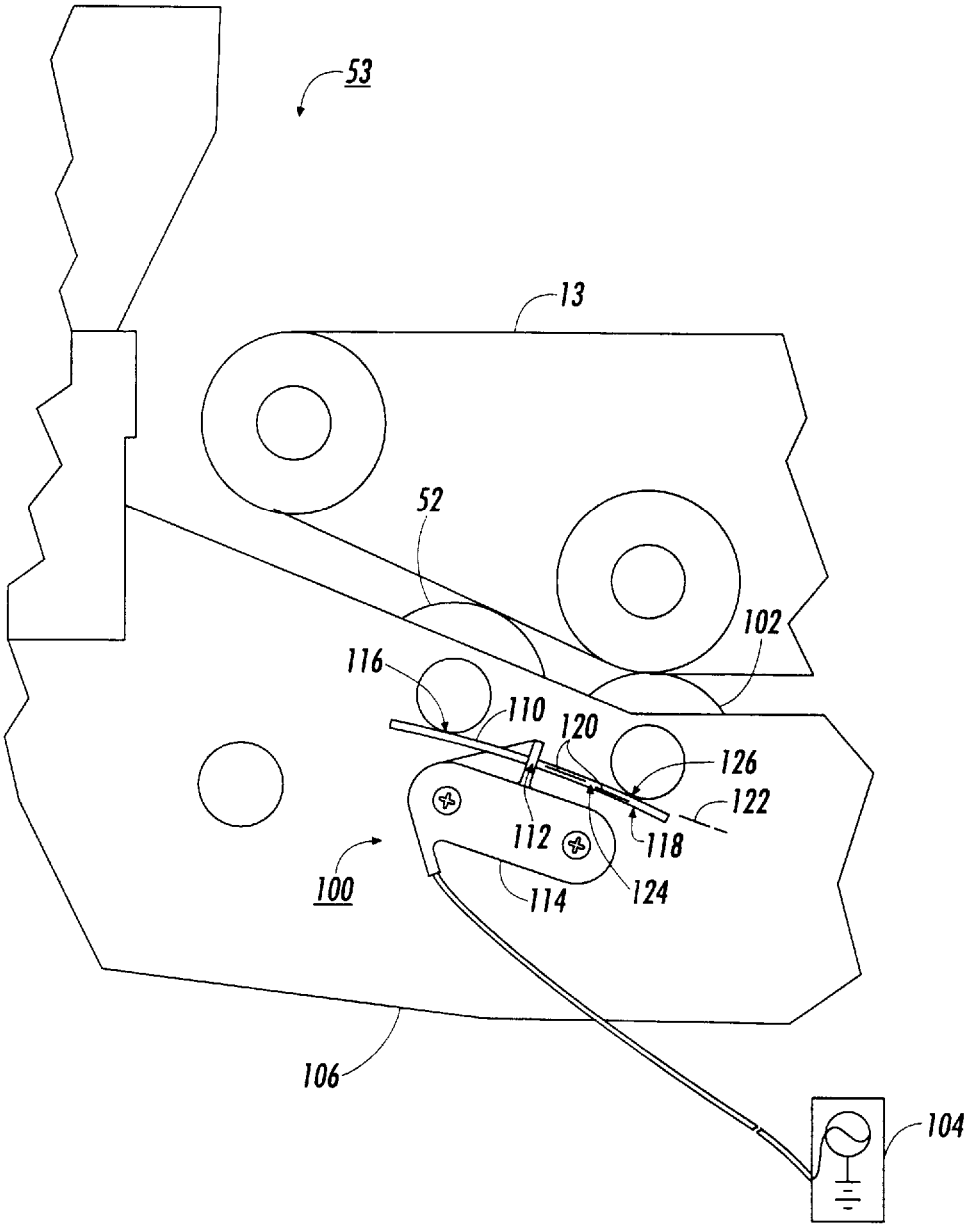
FIG. 1 is partial plan view of a developer unit including a device having a multiplicity of electrically conductive fibers extending in a parallel direction for transferring electrical charge according to the present invention.

According to the present invention and referring to FIG. 1, the electrical charge transferring device 100 is shown in greater detail. The electrical charge transfer device 100 includes a body 110 which includes a first contact area 112 for contact with a first element 114 and a second contact area 116 located on periphery 118 of the body 110 and spaced from the first contact area 112. The second contact area 116 establishes contact with a second element, in the form of a first development roller 52 (as shown in FIG. 1). It should be appreciated that the first element 114 may have any suitable shape and configuration capable of transferring the electrical potential toward the first contact area 112. Likewise, it should be appreciated that the second element 52 may be in the form of any feature within the printer or copier machine to which an electrical potential should be applied or any component within the printing machine to which grounding or dissipation of electrical charge is required.

The body 110 includes a multiplicity of electrically conducted fibers 120 extending in a substantially parallel direction parallel to first axis 122 in the longitudinal direction of the body 110.

The body 110 may have any suitable shape. For example, the body 110 may have a varying cross section or a uniform cross section. The body 110 may have a oval, round, polygon, or any particular cross section capable of transferring the electrical potential.

The applicant has found that a body 110 having a cross sectional area that is circular, forming a body with a generally cylindrical rod shaped body, permits the body 110 to contact the second contact area 116 with a concentrated, generally point-type contact. As the first member 52 rotates, the periphery 116 of the body 110 wears during an initial breakdown period causing the contact area to enlarge. The subsequent wear is, however, very minimal. The applicant has found that the use of a rod or cylindrical shaped body provides for a solid continuous contact and minimal wear.

The body 110 includes the multiplicity of conductive fibers 120. The fibers 120 are described in greater detail herein above. Preferably, the fibers 120 are attached to each other providing for a multiplicity of electrical contact paths for the device 100.

Preferably, the body 110 includes a pultruded composite member which will be described in greater detail herein.

Preferably, the multiplicity of electrical conductive fibers 120 are provided within a polymer matrix as discussed above. The plurality of conductive fibers are oriented with in the polymer matrix in a longitudinal direction of the pultruded composite member in the direction of axis 122.

Preferably to minimize stress placed upon the body 110, the body 110 is pivotally mounted about the first contact area 112. To provide such a simple pivotal mounting arrangement, the body 110 is preferably positioned between two members to be charged. For example, as shown in FIG. 1, the body 110 pivots about first contact area 112. In addition to the second contact area 116 in which the body 110 contacts the first development roller 52, the body 110 additionally includes a third contact area 126 in which the body 110 contacts second development roller 130 along outer periphery 118 of the body 110.

Figure 3:
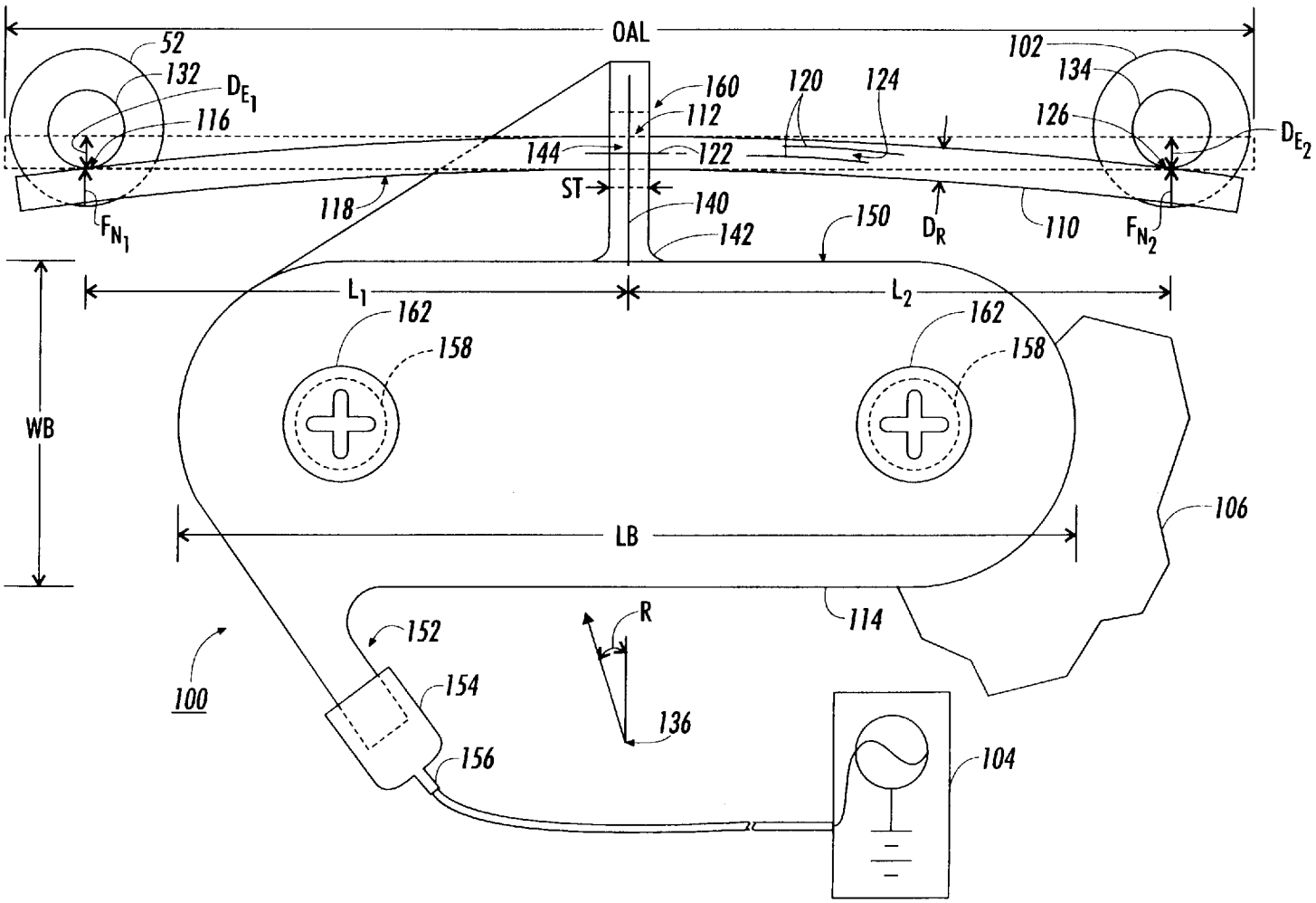
FIG. 3 is a plan view of a bracket for use the device of FIG. 1.

Referring now to FIG. 3, the electrical charge transferring device 100 is shown in greater detail. The body 100 is preferably positioned, equally spaced between first roller 52 and second roller 102. The body 110 contacts first roller shaft 132 and second roller shaft 134 on the respective peripheries thereof. The body 110 may, as shown in FIG. 3, be positioned between the first roller shaft 132 and the second roller shaft 134 such that the body 110 forms an arc R with a center point 136 in alignment with axis 140 centered in support portion 142 of the bracket 114.

The body 110 is preferably deflected a distance $DE_1$ from the horizontal at second contact area 116 and a distance $DE_2$ at third contact area 126. Since the body 110 preferably pivots within the support portion 142 of the bracket 114 and since the support portion 142 of bracket 114 is centrally located, the distance $DE_1$ and $DE_2$ are substantially equal.

The body 110 is permitted to pivot within the support portion 142 of the bracket 114 in any suitable fashion. For example, the body 110 may have a diameter $D_R$ and the support portion 142 may include a conductive member opening 144 which is larger than the diameter $D_R$ of the body 110.

Since normal forces $F_{N1}$ and $F_{N2}$ exerted by the body 110 upon the first and second roller shafts 132 and 134, respectively, are a function of the diameter $D_R$ of the body 110, the material from which the body 110, the material from which the body 110 is made, as well as the deflection $DE_1$ and $DE_2$, by adjusting the dimension $DE_1$ and $DE_2$, the normal forces $F_{N1}$ and $F_{N2}$ exerted upon the shafts 132 and 134 may be adjusted to obtain the optimum electrical contact while minimizing wear on the periphery 118 of the body 110.

The applicant has found that dimensions for $DE_1$ and $DE_2$ of approximately 1 millimeter ±0.5 millimeters is sufficient for body 110 with diameter $D_R$ of approximately 1.7 millimeters when the first roller 52 is spaced from support portion 142 a distance of L1 of approximately 75 millimeters and when the second roller 130 is spaced from support portion 142 a distance of L2 of approximately 75 millimeters.

The overall length, OAL, of the body 110 may be any length slightly longer than the sum of L1 plus L2. In the case of a dimension L1 and L2 of approximately 75 millimeters an overall length of, for example, 175.0 millimeters is sufficient.

The bracket 114 may be made of any suitable durable material that has sufficient strength to support the body and which is not chemically reactive with the components within the copier or printing machine. For example, the bracket 114 may be made of stainless steel.

The bracket 114 may have any suitable shape capable of supporting the body 110. For example, the bracket 114 may have a generally oval shape with a length, LB, of, for example, 100 millimeters and a width, WB, of approximately 50.0 millimeters. As shown in FIG. 3, the bracket 114 may include a plate portion 150 as well as a connector portion 152 for connecting an electrical connector 154 to a conduit 156 in the form of an electrical wire. The conduit 156 is electrically connected to the power supply 104.

The bracket 114 may also include a support portion 142 which is connected to the plate portion 150. The support portion 142 includes opening portion 160 which is substantially perpendicular to the plate portion 150 of the bracket 114. The opening portion 160 serve as a pivot point for the body 110. The support portion 104 has a thickness ST, for example, 2.5 millimeters. The bracket 114 may have any suitable thickness. For example, the bracket 114 may have a thickness T (see FIG. 4) of approximately 2.5 millimeters.

The bracket 114 may be made from any suitable process, for example, it may be forged for pressed from a metal or molded from an electrically conductive plastic. If the bracket 114 is made of a conductive metal, for example stainless steel, the bracket 114 may be made from a sheet of metal and the support portion 114 may be bent into its position with the opening portion 160 perpendicular to the plate portion 150.

The bracket 114 may be secured to the development housing 106 in any suitable manner, such as by welding, gluing, or by fasteners. For example, the plate portion 150 of the bracket 114 may include openings 158 through which fasteners 162 are fitted to secure the bracket 114 to the housing 106.

Figure 4:
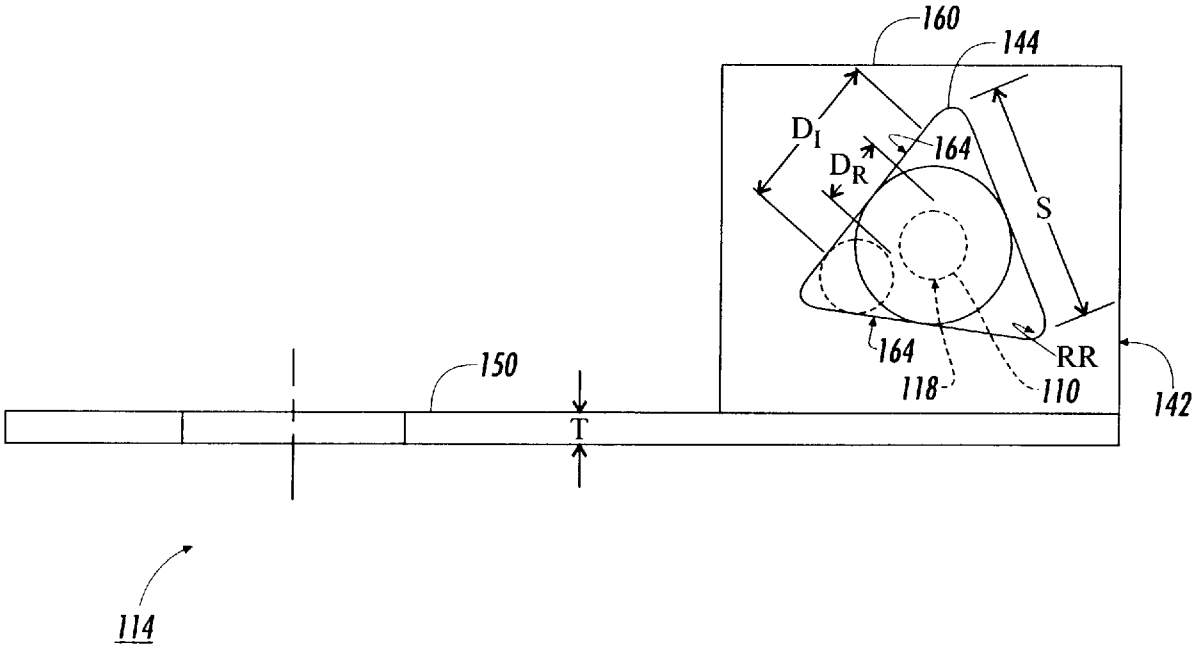
FIG. 4 is an end view of the bracket of FIG. 3.

Referring now to FIG. 4, the support portion 142 of the device 100 is shown in greater detail. The opening portion 106 includes opening 144. The opening 144 may have any suitable shape, for example the opening 144 may be circular, oval, or have any polygon shape.

The applicant has found that the opening 144 is preferably triangular as shown in FIG. 4. The opening 144 is defined by sides S each having approximately an identical dimension. The opening 144 may include radius RR at the corners of the opening 144. The opening 144 preferably defines an inscribed circle having a diameter, $D_I$, slightly larger than the diameter $D_R$ of the body 110. For example, for a diameter $D_R$ of approximately 1.7 millimeters the dimension $D_I$ is approximately 2.0 millimeters.

By providing a opening 144 having a triangular shape, as the body 110 is deflected into its connecting position, the body 110 is urged towards two of the sides 164 of the opening 144 as shown in phantom. As the body 110 contacts the sides 164, the sides 164 wear into outer periphery 118 of the body 110 creating grooves (not shown) within the outer periphery 118 of the body preventing the body 110 from moving along first axis 122 (see FIG. 3).

Figure 5:
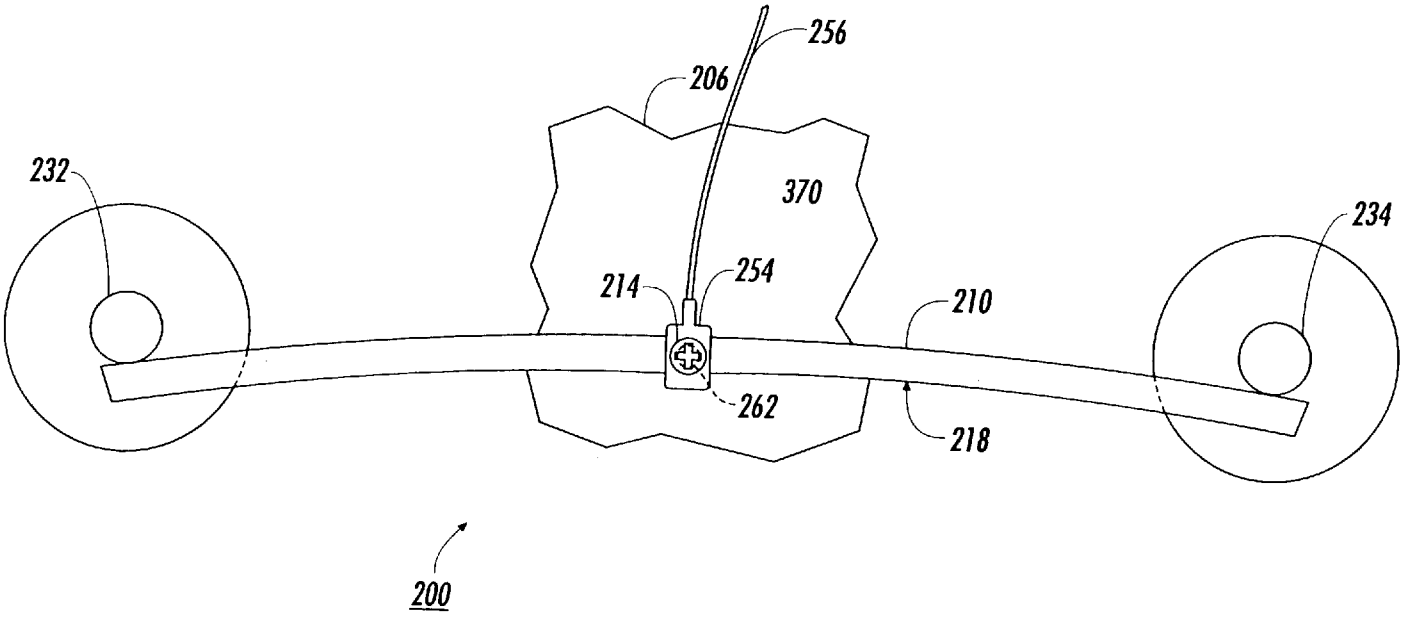
FIG. 5 is a plan view of an alternate embodiment of the charge transfer device of the present invention.

Referring now to FIG. 5, an alternate embodiment of the present invention is shown in electrical charge transferring device 200. Device 200 is similar to device 100 in that device 200 includes a body 210 which is similar to body 110 of device 100. Body 210 is pivotally mounted to developer housing 206 by a fastener 214 in the form of a screw, for example, a metal threaded screw. The screw 214 is connected to body 210 through opening 262 within the body 210.

The body 210 electrically connects the first roll shaft 232 and the second roll shaft 234 along outer periphery 218 of the body 210. Similarly to body 110, body 210 is deflected to provide normal force between the body 210 and the first roll shaft 232 and between the body 210 and the second roll shaft 234. The screw 214 secures a connector 254 positioned over the body 210. The connector 254 is electrically connected to conduit 256. The conduit 256 is connected to the power supply (not shown).

Figure 6:
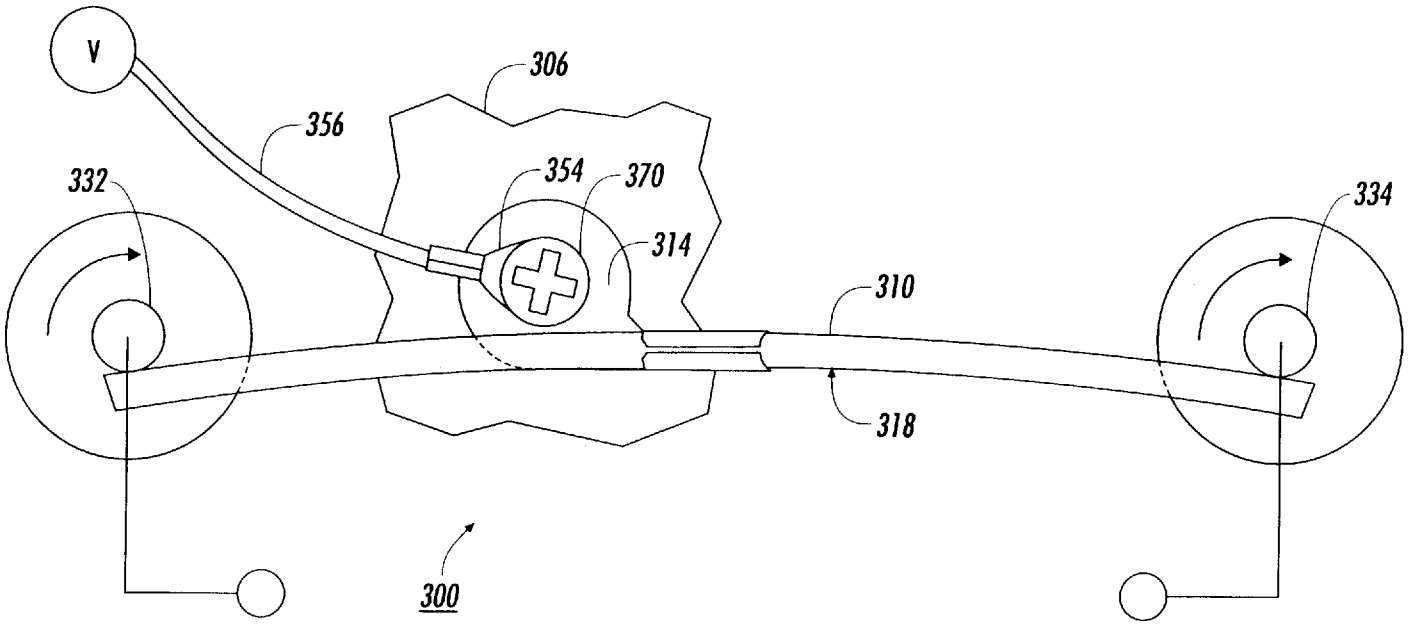
FIG. 6 is a plan view of yet another embodiment of the charge transfer device of the present invention.

Referring now to FIG. 6, another embodiment of the present invention is shown as electrical charge transferring device 300. Device 300 is similar to device 100 in that device 300 includes a body 310 similar to body 110 of the device 100. The body 310 is similar to body 110 of the device 100 and is positioned in a deflected mode between the first roll shaft 332 and second roll shaft 334. Outer periphery 318 of the body 310 contacts the first roll shaft 332 and the second roll shaft 334 thereby transferring the electrical charge.

The body 310 is mounted to development housing 306 by means of first element 314 in the form of a crimp wire connector. The crimp wire connector 314 includes a portion which wraps about the body 310. The crimp wire connector 314 is secured to the developer housing by means of, for example, screw 370. The screw 370 also secures a wire terminal 354 positioned over the first element 314. The wire terminal 354 is connected to wire 356 which in turn is connected to power supply (not shown).

By providing an electrical charge transferring device including a cylindrical, rod shape including fibers extending in a longitudinal axis along the rod, a simple durable device which is flexible is provided. Such a shape is inexpensive to make, inexpensive to mount, and durable.

By providing an electrical charge transferring device including a plurality of conductive fibers within a matrix and utilizing the outer periphery of the device to contact the device to be charged, the wear of the device is minimized and no fibers are free to break off and contaminate the copier or printing machine. Further, the number of short circuits on delicate instrumentations such as development electrodes or charging electrodes is minimized.

By providing an electrical transfer device having a cylindrical diameter, the wear upon the device is minimized and an initial break in contact provides for sufficient and continual contact.

By providing an electrical charge transferring device that is inherently flexible, solid contact may be easily provided, eliminating problems with intermittent contact.

By providing an electrical charge transferring device with a simple cylindrical rod shape, expensive tooling and engineering for the charge transfer device may be eliminated.

By providing an electrical charge transfer device which consists of a generally rod shaped member, a simple, easy, and inexpensive field retrofit may be accomplished to a copier or a printing machine.

By providing an electrical charge transfer device in the form of a cylindrical rod including conductive carbon fibers, the use of a conductive bearing is not required.

By providing an electrical charge transfer device consisting of a series of carbon fibers in a cylindrical form, a device is provided with has the ability for simple, easy diagnosis of electrical faults.

By providing an electrical charge transferring device in the form of a cylindrical rod made from conductive fibers in a matrix, a charging device which may be easily replaced is provided.

By providing a charge transferring device which includes a strong, yet flexible, contact member, the contact member may be used as the spring or contact force for the charging device, eliminating the need for a spring or other force member.

It is, therefore, evident that there has been provided, in accordance with the present invention, an electrostatographic copying apparatus that fully satisfies the aims and advantages of the invention as hereinabove set forth. While the invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. A device for transferring electrical charge between a first element and a second element having an electrical potential therebetween, said device comprising:

a body including a multiplicity of electrically conductive carbon fibers, a substantial portion of said fibers extending in a substantially parallel direction, parallel to a first axis, said body including a first contact area for contact with the first element, said body further including a second contact area on the periphery thereof spaced from the first contact area, the second contact area for contact with the second element, said body further including a third contact area on the periphery thereof spaced from the first contact area, the third contact area for contact with a third element.

2. The device according to claim 1:

wherein the first element comprises a bracket including an opening therein; and wherein said first contact area is defined by an inner periphery of the bracket surrounding the opening.

3. The device according to claim 2:

wherein said body further comprises a third contact area on the periphery thereof spaced from the first contact area, the third contact area for contact with a third element;

wherein the opening has a substantially triangular shape; and wherein the opening of the bracket is positioned between the first element and the second element, the body being flexed so as to provide a normal force to the first contact area for contacting the first element, to provide a normal force to the second contact area for contacting the second element and to provide a normal force to the third contact area for contacting the third element.

4. A developer unit, for use in an electrophotographic printing machine of the type having an electrostatic latent image recorded on a photoconductive member in which an electrical charge is transferred between a first element and a second element having an electrical potential therebetween, the developer unit comprising:

a housing defining a chamber for storing a supply of toner particles therein, the first element operably associated with said housing;

a developer roll operably associated with said housing for transporting the toner particles on a surface thereof from the chamber of the housing to the member; and a device for transferring electrical charge between the first element and the second element, said device including a body having a multiplicity of electrically conductive carbon fibers, a substantial portion of said fibers extending in a substantially parallel direction, parallel to a first axis, said body including a first contact area for contact with the first element, said body further including a second contact area on the periphery thereof spaced from the first contact area, the second contact area for contact with the second element, said body further includes a third contact area on the periphery thereof spaced from the first contact area, the third contact area for contact with a third element.

5. The developer unit according to claim 4:

wherein the first element comprises a bracket including an opening therein; and wherein said first contact area is defined by an inner periphery of the bracket surrounding the opening.

6. The developer unit according to claim 5:

wherein said body further comprises a third contact area on the periphery thereof spaced from the first contact area, the third contact area for contact with a third element;

wherein the opening has a substantially triangular shape; and wherein the opening of the bracket is positioned between the first element and the second element, the body being flexed so as to provide a normal force to the first contact area for contacting the first element, to provide a normal force to the second contact area for contacting the second element and to provide a normal force to the third contact area for contacting the third element.

7. A printing apparatus, including a first element and a second element having an electrical potential therebetween, said printing apparatus including a device for transferring electrical charge between the first element and the second element, said device comprising:

a body including a multiplicity of electrically conductive fibers, a substantial portion of said fibers extending in a substantially parallel direction, parallel to a first axis, said body including a first contact area for contact with the first element, said body further including a second contact area on the periphery thereof spaced from the first contact area, the second contact area for contact with the second element, said body further includes a third contact area on the periphery thereof spaced from the first contact area, the third contact area for contact with a third element.

8. The printing apparatus according to claim 7:

wherein the first element comprises a bracket including an opening therein; and wherein said first contact area is defined by an inner periphery of the bracket surrounding the opening.

9. The printing apparatus according to claim 8:

wherein said body further comprises a third contact area on the periphery thereof spaced from the first contact area, the third contact area for contact with a third element;

wherein the opening has a substantially triangular shape; and wherein the opening of the bracket is positioned between the first element and the second element, the body being flexed so as to provide a normal force to the first contact area for contacting the first element, to provide a normal force to the second contact area for contacting the second element and to provide a normal force to the third contact area for contacting the third element.

10. A device for transferring electrical charge between a first element and a second element having an electrical potential therebetween, said device comprising:

a body including a multiplicity of electrically conductive carbon fibers, a substantial portion of said fibers extending in a substantially parallel direction, parallel to a first axis, said body including a first contact area for contact with the first element, said body further including a second contact area on the periphery thereof spaced from the first contact area and substantially parallel to the first axis, the second contact area for contact with the second element.

11. The device according to claim 10, wherein said body comprises a pultruded composite member and wherein said multiplicity of electrically conductive fibers are provided with a polymer matrix, the plurality of conductive fibers being oriented within the polymer matrix in a longitudinal direction of the pultruded composite member.

12. The device according to claim 10, wherein said body has a substantially cylindrical shape.

13. The device according to claim 10:

wherein the first element comprises a fastener; and wherein said first contact area is defined by an aperture in said body, the aperture having an aperture longitudinal axis perpendicular to said first axis, said fastener fitably engagable within the aperture.

14. A printing apparatus, including a first element and a second element having an electrical potential therebetween, said printing apparatus including a device for transferring electrical charge between the first element and the second element, said device comprising:

a body including a multiplicity of electrically conductive fibers, a substantial portion of said fibers extending in a substantially parallel direction, parallel to a first axis, said body including a first contact area for contact with the first element, said body further including a second contact area on the periphery thereof spaced from the first contact area and substantially parallel to the first axis, the second contact area for contact with the second element.

15. The printing apparatus according to claim 14, wherein said body comprises a pultruded composite member and wherein said multiplicity of electrically conductive fibers are provided with a polymer matrix, the plurality of conductive fibers being oriented within the polymer matrix in a longitudinal direction of the pultruded composite member.

16. The printing apparatus according to claim 14, wherein said body has a substantially cylindrical shape.

17. The printing apparatus according to claim 14:

wherein the first element comprises a fastener; and wherein said first contact area is defined by an aperture in said body, the aperture having an aperture longitudinal axis perpendicular to said first axis, said fastener fitably engagable within the aperture.

* * * * *